United States Patent [19]

Bergstrom

[11] 4,253,247

[45] Mar. 3, 1981

[54] STEAM DISTRIBUTOR

[75] Inventor: William E. Bergstrom, Portland, Oreg.

[73] Assignee: Eppco, Inc., Portland, Oreg.

[21] Appl. No.: 69,293

[22] Filed: Aug. 24, 1979

[51] Int. Cl.[3] ..... F26B 13/10

[52] U.S. Cl. ..... 34/155; 34/48; 34/54; 34/34; 137/883

[58] Field of Search ..... 34/48, 54, 34, 155; 162/252, DIG. 11; 137/883

[56] References Cited

U.S. PATENT DOCUMENTS

| | | | |
|---|---|---|---|
| 3,085,347 | 4/1963 | Justus | 34/54 |
| 3,214,845 | 11/1965 | Huffman | 34/54 |
| 3,643,694 | 2/1972 | Duke et al. | 137/883 |
| 3,726,757 | 4/1973 | Dupasquier | 162/290 |
| 3,770,578 | 11/1973 | Spurrell | 34/25 |
| 3,945,881 | 3/1976 | Speidel | 162/208 |
| 3,962,799 | 6/1976 | Lapointe et al. | 34/54 |

*Primary Examiner*—Larry I. Schwartz
*Attorney, Agent, or Firm*—Klarquist, Sparkman, Campbell, Leigh, Hall & Whinston

[57] ABSTRACT

The specification discloses a hot gas distributor in a paper making machine. The distributor includes a pipe supported by end plates and supporting an elongated hood divided by partitions into a multitude of chambers. Centered in each chamber is a tubular nozzle extending through aligned holes in the pipe. Hot gas in the pipe flows into the nozzle through ports in the nozzle and down through the nozzle into the chamber and through a slotted arcuate plate forming the bottom of the chamber. Adapter blocks on the pipe support the nozzles and bonnets which support pneumatic actuators and through which connecting rods extend. A piston-like control plug or valve member on the rod closes the ports in nozzles to the extents that the pneumatic actuators are set to differentially dry a paper web just below the hood.

4 Claims, 5 Drawing Figures

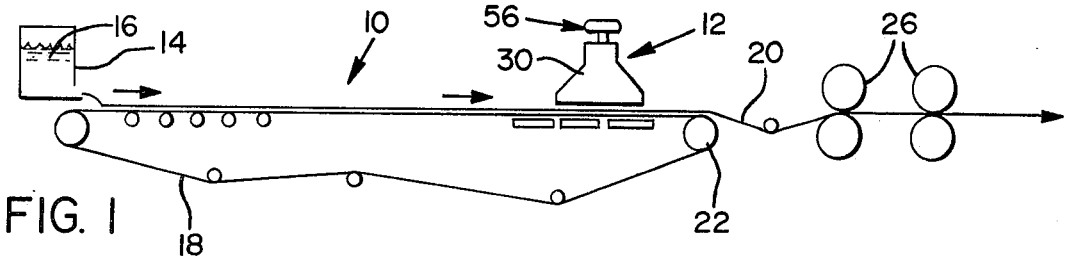
FIG. 1
FIG. 2
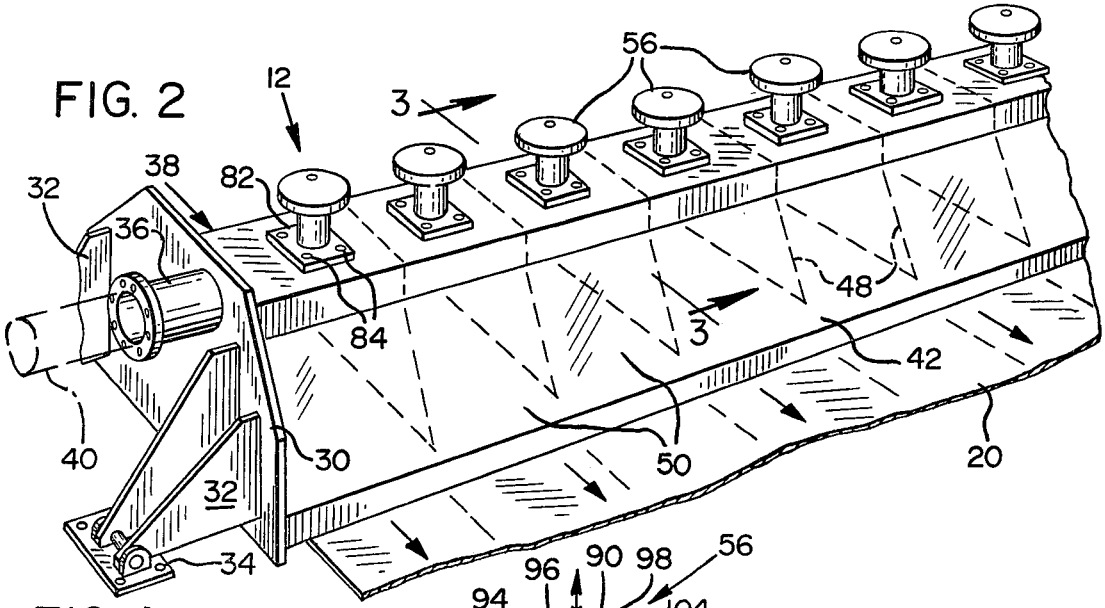
FIG. 4
FIG. 5
FIG. 3
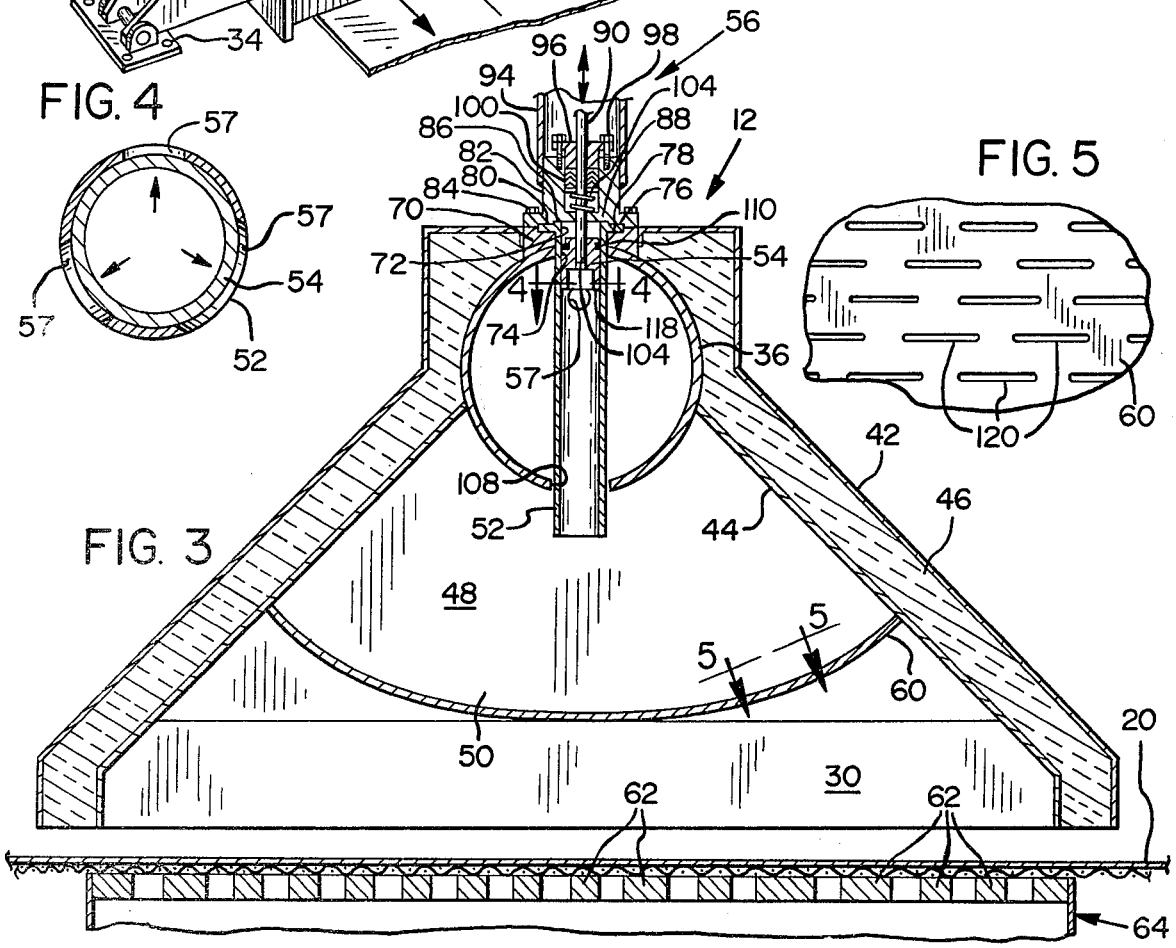

STEAM DISTRIBUTOR

BACKGROUND OF THE INVENTION

In building a steam or hot air distributor which consists of a main distributor pipe or chamber with many pipes out of the chamber, there are many difficulties presented by differential thermal expansion between the main steam distributor and the vessel or chamber into which the individual pipes feed. This type of system normally consists of a main steam chamber with pipes fed through a valve and some type of an expansion joint between the main steam distributor and the vessel being fed through the valve.

In the paper industry, it has been a practice to provide steam distributor over drying components on the Fourdrinier paper machine and in the press section. The steam is blown down on top of the sheet and through the sheet to improve drying. Normally, there is a vacuum device under the steam distributor on the other side of the paper or pulp mat. This is normal but not necessary. In most drying operations, it is difficult to get a uniform moisture profile across the sheet of paper or pulp. This non-uniformity causes many problems in the industry and it is desirable to have a method of correcting discrepancies in the moisture profile. Our invention consists of a multi-chambered steam distributor with separate steam flow control to each of these chambers. In the past, this has been accomplished to some extent using various normal means of connecting pipes and valves to feed steam into various areas. My invention consists of a multi-chambered steam hood with the means of steam distribution to each chamber provided by a steam distributor which has the flow control as an integral part of the distributor rather than as a separate piping system.

Steam flows from the pressurized steam distributor through port holes in the chamber nozzle into each profile chamber. The flow is controlled from zero to 100% by raising or lowering the control plug. This raising or lowering action can be actuated with any device, such as an air cylinder, an air or hydraulic diaphragm, or an electrical means. Flow control could also be obtained in a rotary motion by having holes in the plug which would line up with holes in the chamber nozzle. The heating gas need not necessarily be steam but could be any other hot gas.

In order to correct moisture distribution in most paper products, it is desirable to automatically control the cross machine moisture content using a steam shower as described above. Most machines have continuous moisture scanners which read the sheet moisture content across the machine as the paper is manufactured. The information from this continuous measurement can be fed into a controlling computer or analog computer and the steam flow can be automatically controlled according to this information.

SUMMARY OF THE INVENTION

The invention provides a hot gas distributor in which gas flow controlling devices are mounted on hot gas supply pipes and direct the gas into compartments positioned over a web of paper being formed.

In the drawings:

FIG. 1 is a schematic view of a paper making machine including a hot gas distributor forming one embodiment of the invention;

FIG. 2 is an enlarged, fragmentary, perspective view of the distributor of FIG. 1;

FIG. 3 is a vertical sectional view taken along line 3—3 of FIG. 2;

FIG. 4 is an enlarged, horizontal sectional view taken along line 4—4 of FIG. 3; and FIG. 5 is an enlarged, fragmentary, top plan view taken along line 5—5 of FIG. 3.

There is shown in the drawings a paper making machine 10 (FIG. 1) including a hot gas distributor 12 forming a specific embodiment thereof. The machine shown is of the Fourdrinier type and includes a pulp box 14 feeding pulp mixture 16 to a web-like conveyor 18 on which the liquid is drawn from the pulp to leave a paper web 20, which travels partially dried under the distributor and over the usual subsequent couch roll vacuum 22, a press section 26, further dryers (not shown) and a known moisture measuring device (not shown) which measures the moisture content across the sheet. The distributor is adjusted manually or automatically to reduce the moisture variations in the cross direction.

The hot gas distributor 12 (FIG. 2) includes end plates 30 at each end, each supported by a pair of legs 32 carried by feet 34 mounted on the conveyor frame (not shown) outside the path of the conveyor. A pipe 36 is supported by the end plates 30 and supports a hood 38. A steam pipe 40 supplies a hot gas, in the present instance, steam from a suitable source to the pipe 36. The hood includes outer shell 42, an inner shell 44 and insulation 46 positioned between. Transverse partitions 48 divide the hood into a multitude (at least six) of chambers or compartments 50 spanning the entire width of the web 20. Nozzles or tubes 52, individual to the compartments, each supplies steam to its compartment in accordance with the setting of a valve member 54 of a pneumatic valve 56 individual to that chamber and controlled by the moisture profile measuring device or manually. The steam travels through the pipe 36, through ports 57 into the tubular nozzles 52, through the nozzles into the chambers 50, through slotted, arcuate diffusing plates 60, through the web 20 and a supporting screen or vacuum box cover 62 forming the top of a known vacuum box 64, the screen being either stationary or tracking. The diffusion plates may be drilled plates of different patterns. The plates may be omitted to leave an open bottom chamber.

Each valve 56 (FIG. 3) includes a base or adapter ring 70 bolted or welded to the pipe 36 with a bore 72 aligned with a hole 74 into the pipe. A flange 76 of the nozzle 52 fits in counterbores 78 and 80 in the base and a flanged bonnet 82 secured by bolts 84 to the base. A boss portion 86 of the nozzle fits in counterbore 88 in the bonnet, and a connecting rod 90 carrying the valve member is connected to the valve actuator. A housing 94 of the actuator is secured rigidly to the bonnet. A packing gland 96 is pressed by bolts 98 against packing 100 supported by a washer and a spring 104 in a counterbore in the bonnet. The nozzle 52 extends loosely through a hole 108 in the pipe 36 aligned with the hole 74. The joint between hole 108 and nozzle 52 may be sealed or left with a small clearance to allow easy removal of nozzle. There preferably are three of the circular ports 57 positioned at different heights for desired flow characteristics. A piston ring 110 is mounted in an annular groove in the valve member, and the connecting rod is screwed into a tapped bore 114 in the valve member, which has a counterbore 116 to define a skirt portion 118.

The plate 60 (FIGS. 3 and 5) has staggered rows of slots 120 to cause the steam to flow substantially uniformly to the portion of the web 20 under the compartment. The plates 60 extend from each partition to the next.

The chambers 50 may be left open or covered with various types of plates 60. The chambers may be packed with material to quiet the flow noise. Steel wool would be a typical packing material.

I claim:

1. In a hot gas distributor for feeding a hot gas into a chamber from a source of said gas, the combination comprising:

a pipe in said chamber for conveying a hot gas from a source thereof, a nozzle tube extending transversely through said pipe, said tube having an inlet port in the wall thereof within said pipe to provide communication between the interior of said tube and said pipe, means mounting said tube at one end thereof to said pipe in gas tight engagement therewith, the other end of said tube opening into said chamber, a valve plug slidably mounted in said tube for movement between a first, valve closing, position between said inlet port and said other end of said tube and a second, valve open, position between said inlet port and said one end of said tube, and a valve actuator mounted exteriorly of said pipe and operatively connected to said valve plug through said tube one end for effecting movement of said valve plug between said positions.

2. In combination, wall means defining a chamber for receiving a hot gas, a pipe mounted within said chamber adjacent a wall thereof for conveying a hot gas to said chamber from a source thereof, a nozzle tube extending transversely through said pipe substantially normally to said wall, said tube having an inlet port in the wall thereof within said pipe to provide communication between the interior of said tube and said pipe, the end of said tube remote from said chamber wall being in open communication with said chamber, a valve plug slidably mounted in said tube for movement between a first, valve closing, position between said inlet port and said remote tube end and a second, valve open, position between said inlet port and the opposite end of said tube, means removably mounting said tube one end to said chamber wall, and valve actuating means mounted on said mounting means exteriorly of said chamber and operatively connected to said valve plug for moving said plug between said positions.

3. In a gas distributor, a pipe for conveying a gas from a source thereof, and valve means for controlling the flow of gas from said pipe including, a tube extending transversely of said pipe through substantially diametric openings therein, an adapter ring secured to the exterior of said pipe concentric with one of said pipe openings, a valve bonnet removably attached to said adapter ring, said tube having a flange on one end thereof clamped between said adapter ring and said bonnet, an inlet port in the wall of said tube, a valve plug slidably mounted in said tube for movement between a first position between said port and the end of said tube remote from said flange and a second position between said port and the other end of said tube, and valve operating means operatively connected to said valve plug and extending through said bonnet for effecting movement of said plug between said positions, whereby said tube and said valve plug may be removed for replacement or repair by disengagement of said bonnet from said adapter ring and withdrawal of said plug and tube through said ring.

4. The combination of claim 3 wherein said pipe is positioned within a chamber adjacent a wall of chamber, and said bonnet extends outwardly of said chamber through an opening in said wall.

* * * * *